US005328299A

United States Patent [19]

Degen et al.

[11] Patent Number: 5,328,299

[45] Date of Patent: Jul. 12, 1994

[54] JIG FOR CONSTRUCTING PILES FROM CONCRETE OR SIMILAR MATERIAL IN THE GROUND

[76] Inventors: Wilhelm S. Degen, Sennhuettenstrasse 12, 8810 Horgen, Switzerland; Alexander Degen, Hassenham 8, 8255 Schwindegg, Fed. Rep. of Germany

[21] Appl. No.: 979,701

[22] Filed: Nov. 18, 1992

[30] Foreign Application Priority Data

Nov. 22, 1991 [DE] Fed. Rep. of Germany ..... 4138443

[51] Int. Cl.[5] ..... E02D 5/18

[52] U.S. Cl. ..... 405/240; 405/233; 405/232

[58] Field of Search ..... 405/240, 241, 242, 267, 405/266, 232, 233

[56] References Cited

U.S. PATENT DOCUMENTS

| | | | |
|---|---|---|---|
| 3,429,126 | 2/1969 | Wey | 405/267 |
| 3,823,562 | 7/1974 | Bacmanak | 405/267 |
| 4,057,969 | 11/1977 | Rochmann | 405/240 X |
| 4,126,007 | 11/1978 | Mars | 405/240 x |
| 4,877,357 | 10/1989 | Verstraeten | 405/267 |

FOREIGN PATENT DOCUMENTS 2236901 2/1973 Fed. Rep. of Germany .

*Primary Examiner*—Dennis L. Taylor
*Attorney, Agent, or Firm*—Irvin A. Lavine

[57] ABSTRACT

A jig for constructing piles of concrete or similar hardenable grout material in the ground, with two, three or four parallel vibrated pipes, which are bound together by a common displacement casing and together therewith form a total cross section with closed geometric form. At the lower end, the displacement casing has sliding faces that converge obliquely downward.

9 Claims, 4 Drawing Sheets

JIG FOR CONSTRUCTING PILES FROM CONCRETE OR SIMILAR MATERIAL IN THE GROUND

Figure 1:
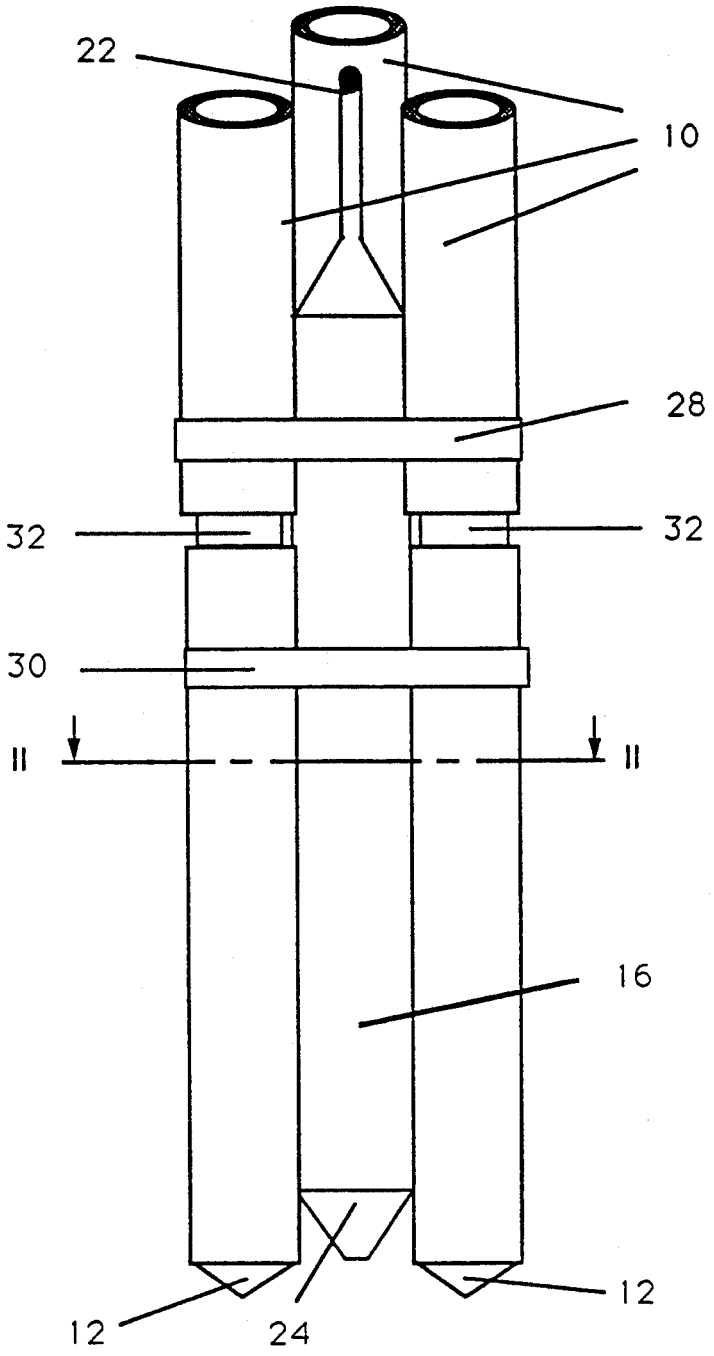

The invention relates to a jig for constructing piles from concrete.

A jig of this type is known from West German Laid-open Application 2,236,901. However, this known jig uses more than one vibrated pipe on a common guide rail only for the case that the vibrated pipes are disposed side-by-side in line and are used for constructing a narrow subterraneous curtain in the ground. To construct a pile in the ground, only one single vibrated pipe can be used in the known jig. For better guidance in the ground, guide blades can be disposed on both sides of the tip of the vibrated pipe. Such a vibrated pipe has a diameter of about 40 cm. This diameter cannot be substantially enlarged, since experience has shown that it represents an optimum for penetration of the vibrated pipe. The rate of penetration of a vibrated pipe into the ground is greater the smaller its diameter, the higher its vibration frequency and the larger its vibration amplitude.

In the known jig, the inside of the hollow vibrated pipe is used as the concrete delivery pipe, which is downwardly open at the tip of the vibrated pipe. During penetration of the jig into the ground, the concrete delivery pipe is filled with pressurized concrete or similar material, so that soil cannot penetrate into the open end of the delivery pipe.

According to the prior art, piles of relatively large diameter are installed either by casting and curing them to finished condition above ground and then driving them into the ground by means of a pilodriver, thus producing great noise and vibration, or by tediously boring holes in the ground by means of a boring machine and then pouring the concrete into the resulting holes.

The object of the invention is to provide a jig for producing piles with closed cross sections substantially exceeding the cross section of a vibrated pipe of 40 cm diameter and having a minimum cross-sectional dimension of about 40 cm or larger which jig enables the piles to be installed simply and rapidly in the ground.

The vibrated pipes, which have an elastically stiff connection to the displacement casings, cause the entire jig to vibrate such that it can penetrate efficiently into the ground. Inclined converging faces of the displacement casing work together with the closed conical tips of the vibrated pipes to displace the soil. The closed crosssectional form of the jig provides for favorable compaction of the displaced soil. After the jig has been sunk into the ground, concrete or similar hardenable grout material is injected through a material delivery pipe, located between the vibrated pipes into the hole created in the ground while the jig is being withdrawn, thus filling the hole completely, as is done with the known jig. Thereby a pile of concrete or similar material is formed with considerably larger dimensions than can be achieved with a known jig having a single tubular vibrator.

The displacement casing consists preferably of hollow steel plate or similar material. It has been found that the crosssectional ratio is particularly expedient when the ratio of the cross section of the displacement casing to the sum of the cross sections of all vibrated pipes is approximately 1:2, although this ratio is not imperative for the jig according to the invention.

A material delivery pipe is preferably disposed in the displacement casing, where it is best protected against damage and is downwardly open close to an opening of the displacement casing. To prevent soil from entering the displacement casing, the two openings can also coincide.

There are provided various embodiments of devices for fixing the parts of the jig to each other as well as to the guide rail carrying them.

For certain soil compositions, it may prove helpful to provide a larger opening at the bottom end of the displacement casing, through which opening the soil can enter during sinking of the jig. In a further embodiment of the invention, the opening of the displacement casing can be closed after receiving the soil, and so the soil that has entered can be removed with the jig. For this purpose, the displacement casing has a greater height, so that it extends along the entire length of the vibrated pipes.

Figure 3:
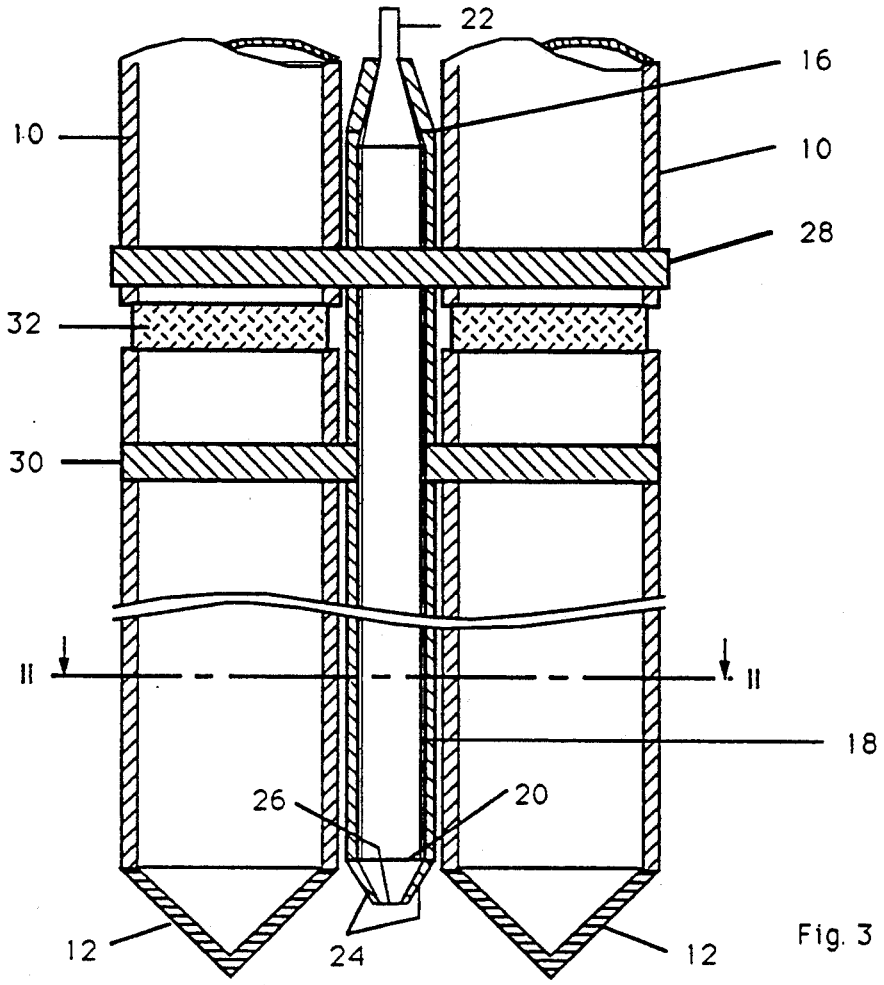
Figure 2:
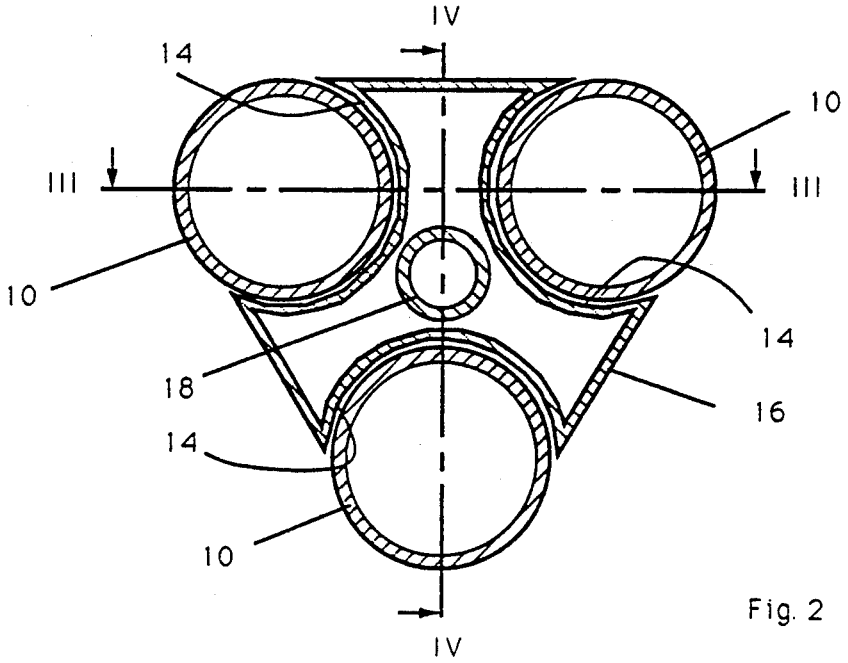
Figure 4:
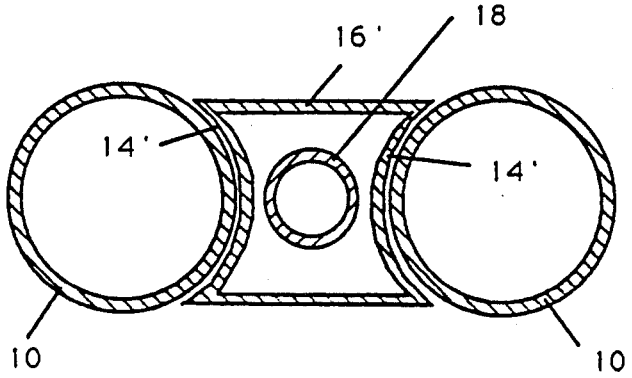
Figure 6:
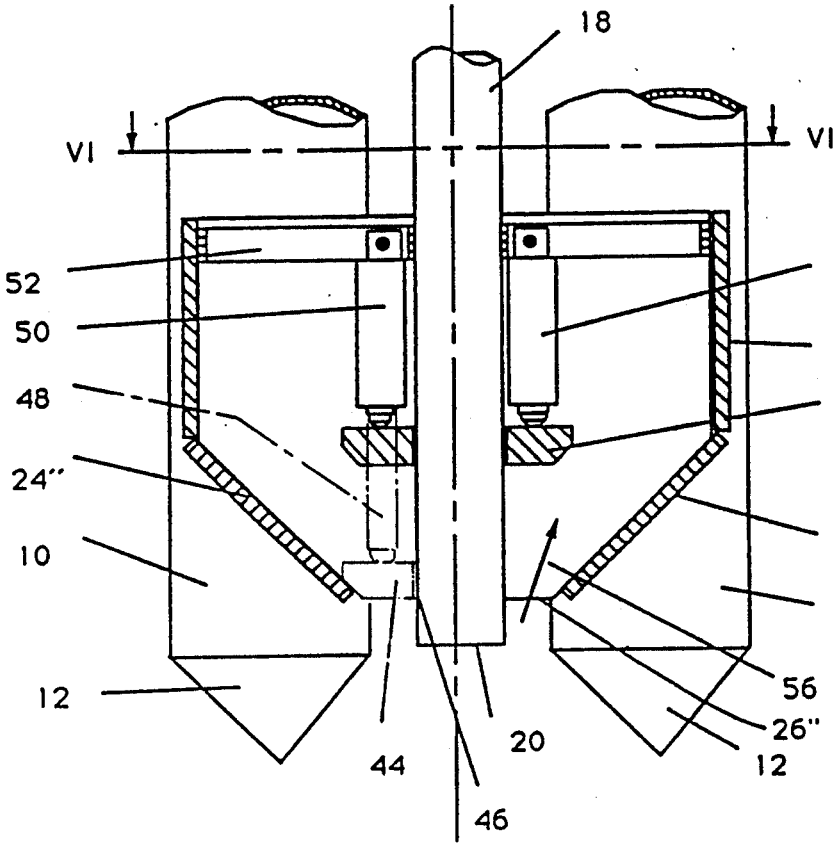
Figure 5:
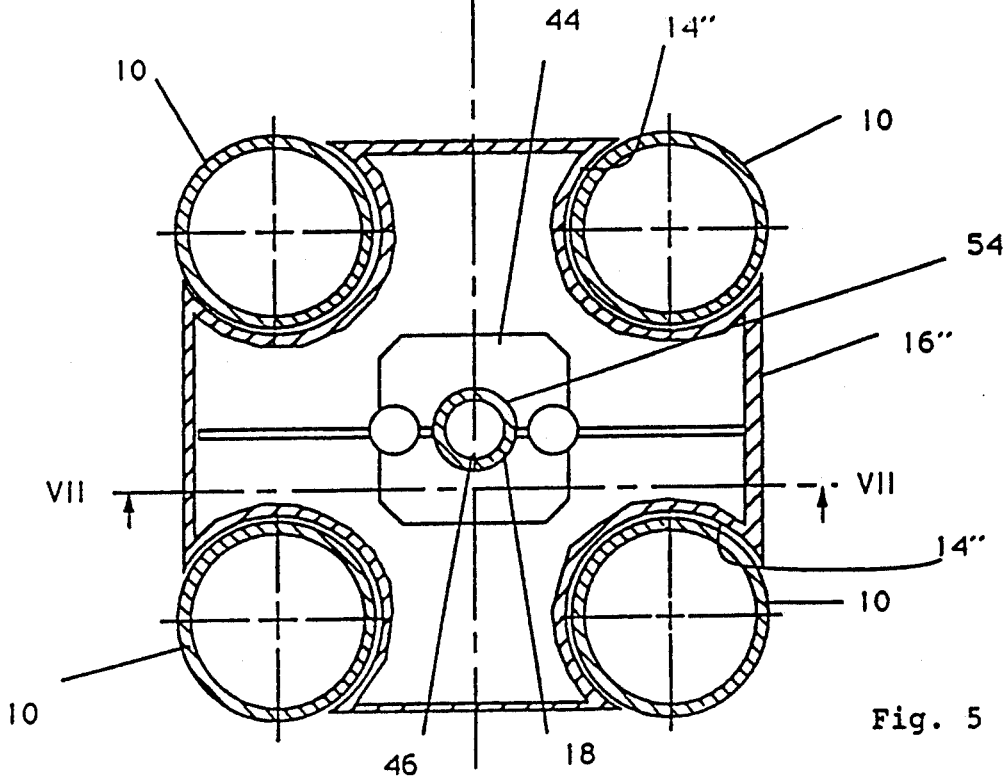

Practical examples of the invention will be explained in more detail by reference to the figures, wherein:

FIG. 1 shows a side view of a first embodiment with three vibrated pipes, the top end of the jig and the parts carrying it having been omitted, FIG. 2 shows an enlarged section along the line II—II in FIG. 1, FIG. 3 shows a section along the line III—III in FIG. 2, FIG. 4 shows a section corresponding to FIG. 2 through a second embodiment with two vibrated pipes, FIG. 5 shows a section along the line VI—VI in FIG. 6, through a third embodiment with four vibrated pipes, and FIG. 6 shows a section along the line VII—VII in FIG. 5.

Like symbols are used for like or corresponding parts in all figures.

In the practical example illustrated in FIGS. 1 to 4, there are provided three parallel vibrated pipes 10 with closed conical tips 12 at their lower ends. The vibrated pipes 10 are disposed in longitudinally extending are recesses 14 having approximately semicircular cross section and being part of a common longitudinally extending displacement casing 16 consisting of hollow steel plate. In this arrangement, together with the displacement casing, 16, the three pipes 10 have a cross section with approximately the form of an equilateral triangle with rounded corners, as shown in FIG. 2. This closed form is therefore very suitable both for penetration into the ground and for construction of a pile of concrete or similar material with approximately the same cross section.

At the center of the inside of the displacement casing 16 there is provided a material delivery pipe 18 that runs parallel to the vibrated pipes 10 and that ends in a downwardly directed opening 20 at the bottom and has a feed line 22 at the top. At its lower end, approximately in the region of the tips 12 of the vibrated pipes 10, the displacement casing 16 has inclined faces 24 that converge obliquely downward to form a downwardly directed conical configuration and downwardly directed opening 26. The opening 26 is disposed such that concrete or similar material introduced under pressure in the material delivery pipe 18 can flow out through the opening into the soil while the jig is being pulled back up after completion of the sinking operation, so that the material completely fills the hole that has been opened in the ground.

Each vibrated pipe is interrupted in its upper region in a way known in itself by an elastically stiff coupling member 32, by means of which the vibrations generated in the lower part of the vibrated pipe by the vibrating motor (not shown) are largely damped in the segment of the vibrated pipe 10 located above the coupling member 32. These upper segments of the vibrated pipes are bound together by a rigid carrier member 28, while the lower segments of the vibrated pipes 10 subjected to the jogging vibrations are bound together as well as to the displacement casing 16 by an elastically stiff connecting member 30. The connecting member 30 is preferably mounted at approximately the height of the minimum amplitude of the vibrated-pipe vibrations. By means of the carrier member 28 and the connecting member 30, the vibrated pipes 10 are held stably in the recesses 14 of the displacement casing 16.

In the simpler embodiment shown in FIG. 4, only two vibrated pipes 10 are disposed in recesses 14' having cross sections in the form of arcs of circles and belonging to a displacement casing 16', whereby the total cross section of the jig is substantially an approximately elongated rectangle, with rounded corners formed by the vibrated pipes 10. In its other features, this embodiment can be formed in a manner analogous to the embodiment illustrated in FIGS. 1 to 3.

Finally, the embodiment illustrated in FIGS. 5 and 6 has four parallel vibrated pipes 10, which are disposed in corresponding recesses 14'' of a displacement casing 16'' and together therewith give the jig an approximately square total cross section, with rounded corners formed by the vibrated pipes 10. By means of this jig, therefore, a very stable concrete pile with approximately square cross section is produced.

In this embodiment with relatively large cross section, it is expedient under certain circumstances to collect some of the displaced soil inside the displacement casing while sinking the jig, and to remove such soil when the jig is withdrawn from the borehole. For this purpose, the inclined faces 24'' at the lower end of the displacement casing 16'' form a substantially larger opening 26'', through which the material delivery pipe 18 emerges and projects to some extent. The opening 26'' is substantially square and can be closed by a closing slide 44, which is also square and which is movable in the axial direction of the jig, i.e., parallel to the vibrated pipes 10, the closed position being illustrated in the left half of FIG. 6. The plate-shaped closing slide 44 has a central hole 46, which surrounds the material delivery pipe 30. At the upper side of the closing slide 44 there are pivotably linked the piston rods 48 of two vertically acting hydraulic cylinders, which in turn are pivotably mounted at their upper ends on a retaining yoke 52 welded immovably in the displacement casing 16''. The retaining yoke 52 carries a central ring 54, which surrounds the material delivery pipe 18. In the extended condition of the hydraulic cylinders 50, the closing slide 44 is moved into the closed position shown by dashed lines in the left half of FIG. 6 and, during retraction of the hydraulic cylinders 50, the closing slide moves into the open position 44' shown in solid lines in the right half of FIG. 6. In this open position, soil can enter the inside of the displacement casing 16'' in the direction of the arrow 56 during sinking of the jig. At the lowest point of the sinking movement of the jig, the hydraulic cylinders 50 are extended to close the opening 26''. The soil contained inside the displacement casing 16'' is therefore carried along upward as the jig is withdrawn, so that not only is the resistance opposing sinking of the jig reduced by admission of soil into the displacement casing 16'', but also the operation of filling the resulting hole with concrete or similar material is greatly facilitated. In this embodiment, the displacement casing 16'' extends substantially over the entire height of the vibrated pipes 10, in a manner not shown.

We claim:

1. A jig for constructing structures of concrete or similar hardenable grout material in the ground comprising:

a plurality of spaced, substantially parallel pipes having lower ends with closed conical tips and adapted to be vibrated by a vibrating apparatus, a longitudinally extending displacement casing in the space between said vibrated pipes, said displacement casing having a longitudinally extending arcuate recess for each of said vibrated pipes and matingly receiving a said vibrated pipe therein, said displacement casing having a lower end having a downwardly directed conical configuration with a downwardly directed opening, a securing device extending about said vibrated pipes and confining said vibrated pipes in their respective recesses in said displacement casing, a material delivery pipe for hardenable material extending through said casing and having a lower end adjacent said downwardly directed conical configuration of said displacement casing, and a downwardly directed opening in said lower end of said delivery pipe, whereby said pipes and said displacement casing may readily penetrate the ground and hardenable material in said conical configuration of said displacement casing may prevent entry of soil into said displacement casing.

2. The jig of claim 1, said securing device comprising an elastic encircling member.

3. The jig of claim 1, there being two said vibrated pipes, said displacement casing being between said two vibrated pipes, and said material delivery pipe being between and substantially parallel to said two vibrated pipes.

4. The jig of claim 1, wherein there are three said vibrated pipes, said vibrated pipes being arranged in triangular relationship.

5. The jig of claim 1, there being four said vibrated pipes arranged in rectangular configuration.

6. The jig of claim 1, wherein the securing device is a composite elastomeric and metal member.

7. The jig of claim 1, securing device being at approximately the location of minimum amplitude of the vibrations of said vibrated pipes when vibrated.

8. The jig of claim 1, wherein at least one of said vibrate pipes comprises first and second linearly aligned parts, and elastically stiff coupling connecting said parts, and said securing device comprising a rigid or elastically stiff carrier member.

9. A jig for constructing structures of concrete or similar hardenable grout material in the ground comprising:

a plurality of spaced, substantially parallel pipes having lower ends with closed conical tips and adapted to be vibrated by a vibrating apparatus, a longitudinally extending displacement casing in the space between said vibrated pipes, said displacement casing having a longitudinally extending arcuate recess for each of said vibrated pipes and matingly receiving a said vibrated pipe therein, said displacment casing having a lower end having a downwardly directed conical configuration with a downwardly directed opening, a securing device extending about said vibrated pipes and confining said vibrated pipes in their respective recesses in said displacement casing, a material delivery pipe for hardenable material extending through said casing and having a lower end adjacent said downwardly directed conical configuration of said displacement casing, a downwardly directed opening in said lower end of said delivery pipe, said material delivery pipe extending through said opening in said displacement casing, said material delivery pipe being smaller than said opening in said displacement casing, said material delivery pipe being smaller than said opening and providing a space therebetween, and a closure apparatus movable to selectively open or close said opening, whereby said closure apparatus may be opened to permit entry of soil into said displacement casing and closed to retain soil therein during removal of said jig from the ground.

* * * * *